United States Patent [19]

Bourne

[11] 4,415,200

[45] Nov. 15, 1983

[54] COMBINATION INFANT SEAT AND SWING

[76] Inventor: Carol Bourne, 1226 Villanova Dr., Davis, Calif. 95616

[21] Appl. No.: 194,763

[22] Filed: Oct. 6, 1980

[51] Int. Cl.[3] ..... A47D 1/10

[52] U.S. Cl. ..... 297/174; 297/273

[58] Field of Search ..... 297/174, 273, 274, 277, 297/281, 130

[56] References Cited

U.S. PATENT DOCUMENTS

| | | | |
|---|---|---|---|
| 1,952,467 | 3/1934 | Slee | 297/130 |
| 2,451,667 | 10/1948 | Ducey | 297/174 |
| 2,707,987 | 5/1955 | Gibson | 297/174 |
| 2,994,557 | 8/1961 | King | 297/130 X |
| 3,059,965 | 10/1962 | Fornetti | 297/174 |
| 3,115,364 | 12/1963 | Berlin | 297/130 |
| 3,190,691 | 6/1965 | Desjardins | 297/174 |
| 3,243,229 | 3/1966 | Barnhill | 297/174 X |

*Primary Examiner*—Francis K. Zugel

*Attorney, Agent, or Firm*—Mark C. Jacobs

[57] ABSTRACT

A combination seat and swing for an infant whereby the device can be mounted at a conventional table providing a safe comfortable seat for an infant, then removed from the table and attached to a chain or the like to a tree, cross-beam or other supporting member thereby providing a swing for the infant.

8 Claims, 6 Drawing Figures

COMBINATION INFANT SEAT AND SWING

BACKGROUND OF THE INVENTION

1. Field of the Invention

The invention relates to an infant device; and, more particularly, to a combination seat and swing for a baby.

2. Description of the Prior Art

Various types of infant seats have been suggested over the years which can be mounted to a table or the like, such as those disclosed in U.S. Pat. Nos. 3,190,691; 3,253,860; and 2,489,084. Such devices usually require specific table structure or other means to make them quickly and easily mounted to, and demountable from, the table. Such devices have only a single use; e.g., as a seat, and are generally of metal tubing or the like. None of these devices show or suggest converting the prior table mounted devices to a swing. Obviously, it is quite desirable from both a convenience point of view and economics to have an infant seat which can be quickly and easily attached to most tables, then used seperately as a play device or the like. This device is of special interest, since other convertible seating devices have always been from a seat to a car seat, or seat to a carrier, this latter being made by Cosco, but suitable only for very young immobile infants.

SUMMARY OF THE INVENTION

It is an object of this invention to provide a combination seat and swing for an infant.

It is a further object of this invention to provide a device which can be quickly and easily mounted to most tables.

It is still another object of this invention to provide a device which can be demounted from the table, then quickly and easily converted into a baby's swing.

These and other objects are accomplished by providing a seat which can be inserted onto a table the weight of the infant retaining the seat in position, then demounted from the table and attached, via loops or rings on the seat supports, to a chain or chains or the like extending from an overhanging supporting surface, such as a tree, and used in another orientation as a swing.

DESCRIPTION OF THE PREFERRED EMBODIMENT

Figure 1:
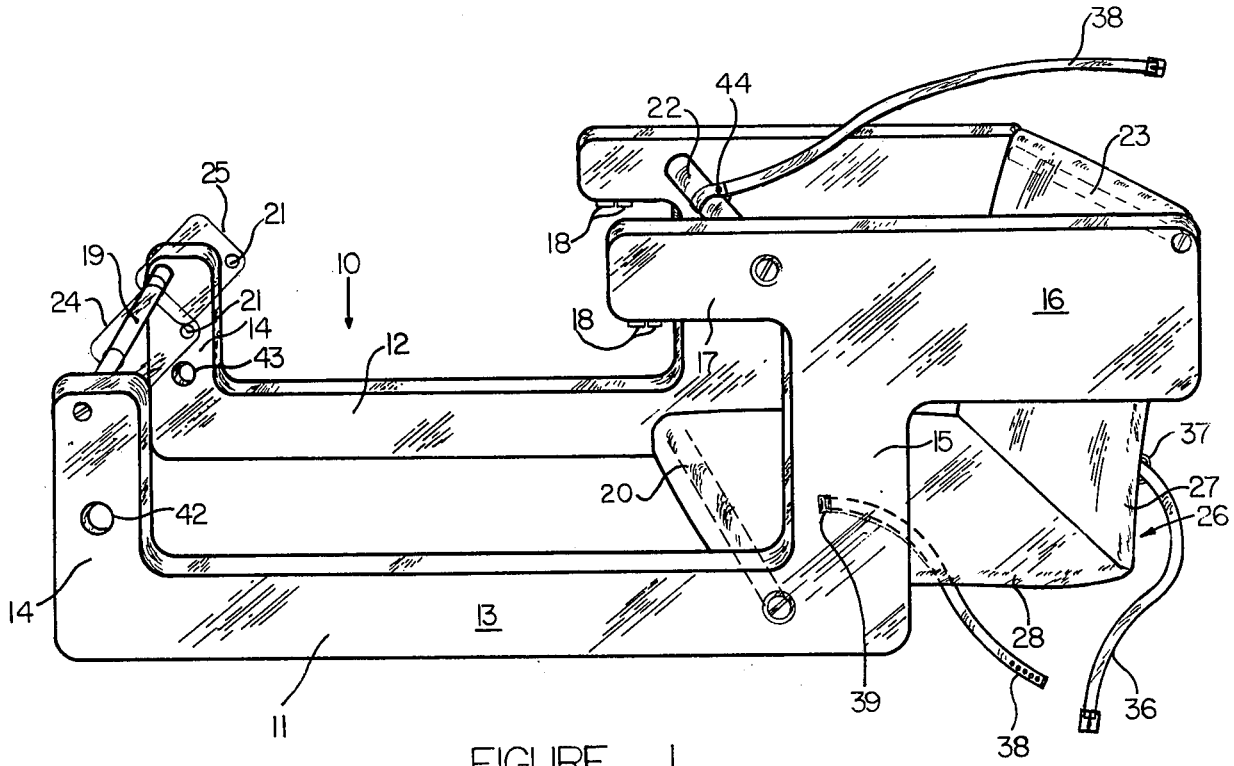
FIG. 1 is a perspective view of a combined seat and swing in accordance with the invention.
Figure 2:
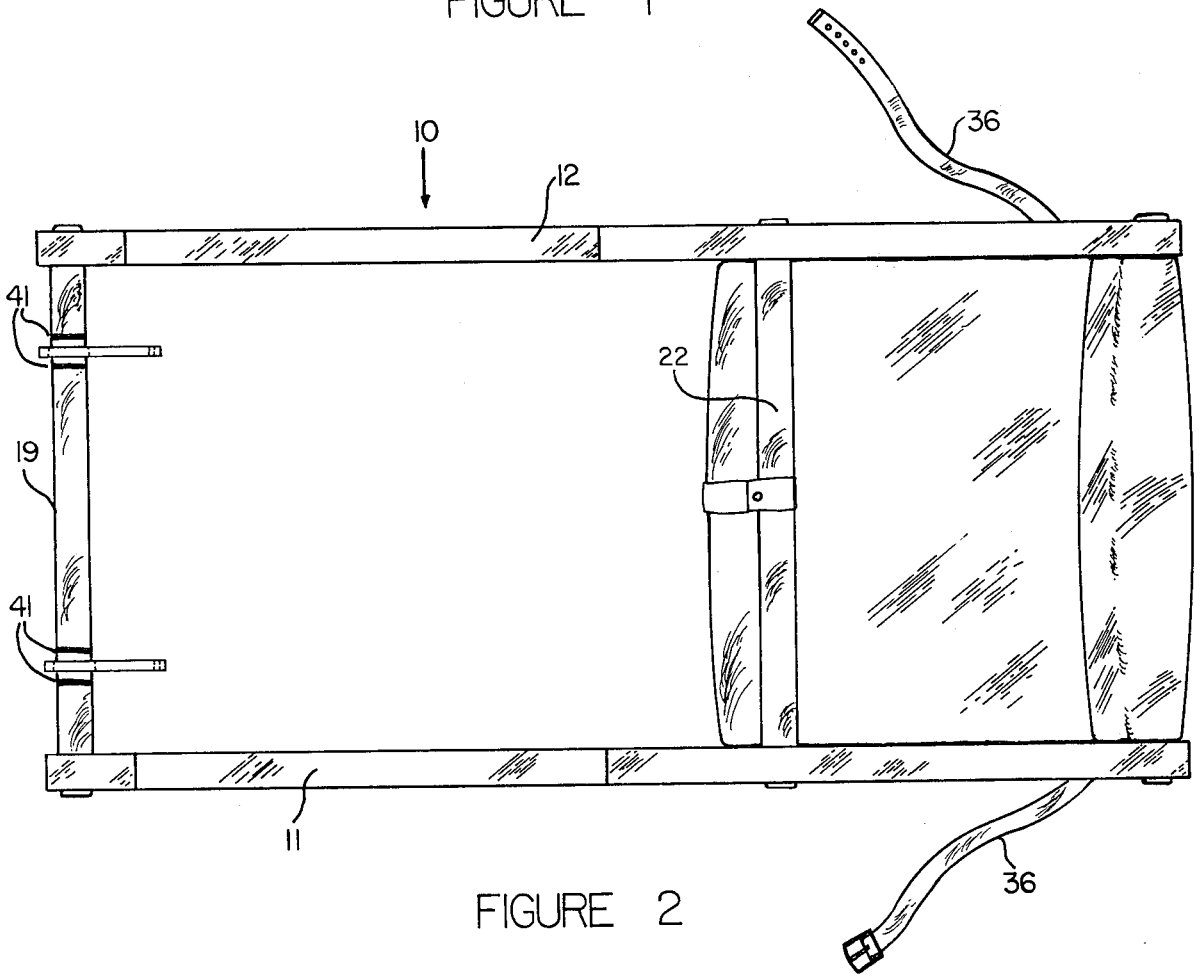
FIG. 2 is a top plan view of the seat and swing of FIG. 1.

Referring now to FIG. 1 of the invention drawing, a combined seat and swing device 10 is shown comprised of a pair of side sections, which include a first horizontal elongated spaced side members 11,12 of a relatively flat thin rigid planar material, such as wood, metal or plastic. Each member 11,12 is comprised of a bottom first horizontal elongated member or portion 13 terminating at each end in terminal vertical extending support members or portions 14,15, respectively.

The upper end of member 15 is integral with a wide upper horizontal portion, parallel to bottom portion 13, but extending in a direction away from portion 13. A second generally horizontal member comprising both of a relatively narrow horizontal portion 17 which extends from portion 16, parallel to bottom portion 13, and toward vertical portion 14. All portions 13 through 17 may be integral; that is, member 11 may be made up of interconnected sections or of one integral piece as shown.

Side member 12 is identical to member 11 so further description is deemed unnecessary. Portion 17 has a cushioning foot or pad 18, such as rubber, glued or otherwise secured to its undersurface. The spaced side members 11,12 are interconnected by dowel rods or bracing members to form a unitary structure. Thus, a first dowel rod 19 interconnects the free ends of vertical portions 14. This may be accomplished in any suitable manner, such as rod 19 passing through aligned apertures in portions 14 and secured therein in any suitable manner, such as friction-fit, nuts and bolts, etc.

A similar rod 20 designated a second bracing member (FIG. 1) interconnects members 11,12 near the junction of portions 13,15. in like manner. Similar rods 22, the third bracing member 23 the fourth bracing member (rod 23 shown in dotted lines in FIG. 1) interconnect sections 11,12, respectively, as shown. The diameter of rods 20 through 23 may vary (and of course the apertures) depending on the strength of the material comprising the rods and may also vary among the rods.

A pair of rings or clips, such as swing members 24,25, which may be plastic or metal or the like, are provided along the rod 19 spaced from each other by spacers 41 and permitted to rotate on rod 19. Alternatively, aligned apertures 42, 43, may be used for rope or chain attachments for swinging. Ropes 32, 33 can be attached to members 24,25 such as by having 32,33 ends insertible in aligned apertures 21 in each clip 24, 25 which are seen to be rotatably disposed on rod 19 so as not to interfere with the underside of the table as will be discussed.

A padded seat and back 26 is provided in device 10 having the seat portion 27 extending from and parallel to portions 12,13 and back portion 28 extending from seat portion 27 vertically upwardly in FIG. 1 to rod 23 and parallel to portion 15. Seat and back 26 may be secured in device 10 by having overlapping portions extending about rods 23 and 20 and secured thereto. That is, seat and back 26 may be comprised of a fabric covered cushioning material with fabric ends passing about rods 23 and 20 and stitched or otherwise secured to the fabric to fasten the seat and back 26 securely in device 10. Of course, other suitable securing means may be provided.

Figure 3:
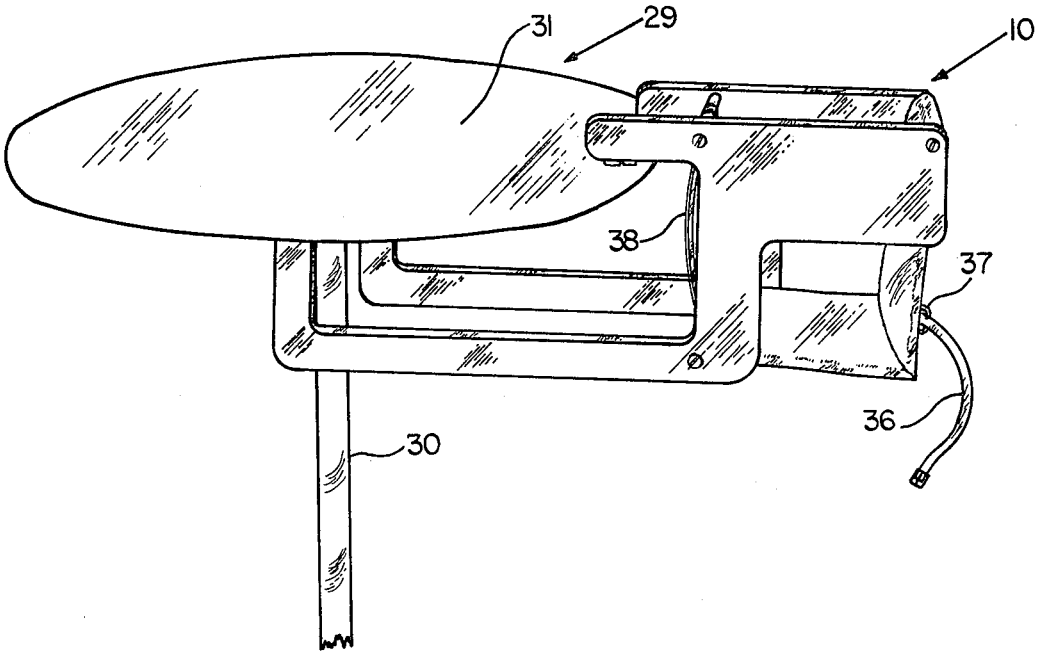
FIG. 3 is a perspective view showing the seat and swing of FIGS. 1 and 2 mounted to a conventional table.

FIG. 3 illustrates how device 10 may be quickly and easily mounted to a conventional table 29. The table 29 has a base 30 and a horizontal flat table portion 31. As can be seen, the pads 18 abut against and rest upon the upper surface of table portion 31 while the upper ends of portions 14 abut against the underside of table portion 31. In this manner, an infant can sit in seat and back 26, the infant's weight serving to maintain portions 14 in abutment against the underside of table portion 31. As can be seen, pads 18 prevent marring of the table surface. The device 10 can be quickly and easily demounted from engagement with table 29 by merely moving device 10 until pads 18 clear the table 29.

Figure 4:
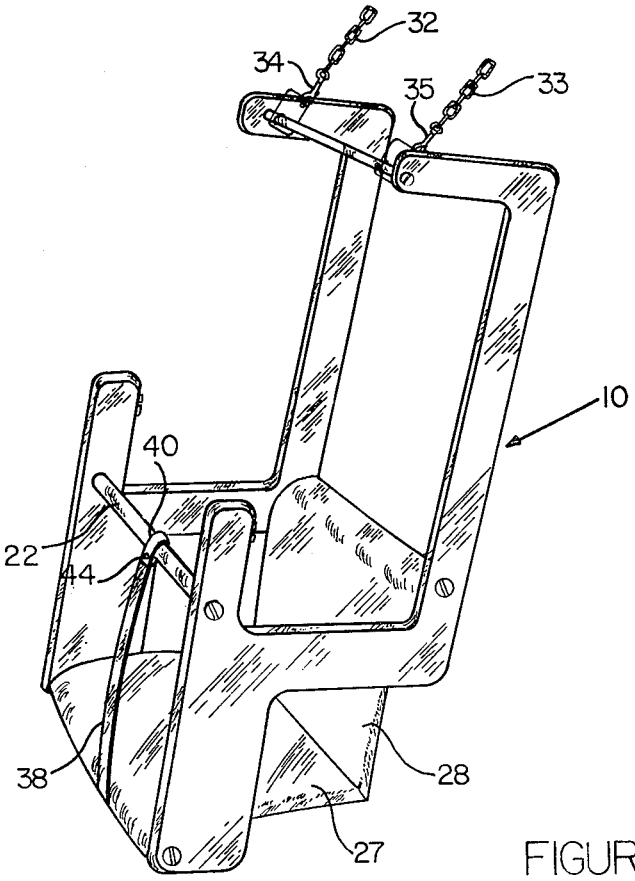
FIG. 4 is another perspective view of the seat and swing of FIGS. 1 and 2 attached to chains for use as a swing.

As shown in FIG. 4, device 10 can then be quickly and easily converted to use as a swing. As shown, a pair of chains 32,33, having releasable hooks or ends, such as links 34,35, respectively, are quickly and easily attached to members 24,25. The other end of chains 32,33 (not visible) may be connected to a tree or cross-beam or other supporting member. Of course, ropes or other elongated means may be used in lieu of chains. Thus, it can be seen that device 10 is quickly and easily converted from a table seat to a swing. The infant sits on seat portion 27, (swing) resting against back portion 28, and holds or grasps rod or bar 22 for support. If desired, a suitable lap belt 36 may be provided on the portion 28 as is well known in the seat art. Belt 36 may extend through aligned loops 37 on the rear of the portion 27, as shown in FIG. 1, so that it is removable, if desired. Of course, other detachable means may be used for belt 36, such as snap fasteners, Velcro material, etc. Also, as shown in FIGS. 1 and 4, a crotch strap 38 may also be provided having an end secureable to the underside of seat portion 27, at end 39, (FIG. 1), and the other end 40 extending about and secured to rod 22, as shown by snap 44.

Seat portion 27 and back portion 28 are of any suitable materials, such as masonite covered with a fabric material enclosing a cushioning material, such as a foamed plastic or the like. As seen in FIG. 3, although the device is most suitable for use as a seat with a table of a conventional thickness, e.g., about $1\frac{1}{4}$ to $1\frac{1}{2}$ inches in thickness, there is some leeway since the device 10 will merely tilt slightly forward or backward depending on the table thickness. There is no need for a tray since the table surface itself functions as the tray. Although various materials may be used, woods and canvas or the like are preferred since it can be easily and economically manufactured from such materials and such materials have a contemporary look that is appealing to the eye. In other words, it is aesthetically appealing in and of itself apart from its use as a swing or seat.

In the discussion above, reference has been made to parts 27 and 28. It is seen that when device 10 is used as a swing, seat portion 27 is in front and a seat, but that in the chair format, portion 27 is the back due to a reorientation. The converse is true for portion 28 which is swing format in the back, yet in chair format is the seat.

While solid rods are contemplated for bars 19, 20, 22 and 23, tubular stock can be used equally as well.

In addition, a one piece molded unit can be employed for seat and back 26 if desired.

It is seen that two means, namely apertures 42 and 43 and swing members 24, 25 are provided for allowing device 10 to swing. Use of swing members 24 and 25 gives more circular motion to the device, as there, swing members pivot or are rotated with respect to brace 19, while the apertures are of course fixed. Typically swing members 24,25 are made of $\frac{1}{4}''$ acrylic plastic and are generally rectangular with chamfered corners.

Hooks shaped like a FIG. 8 can be secured in apertures 42 and 43 to which chains 32 and 33 can be detachably secured to further facilitate swingability, rather than detachably securing the chains 32,33 directly to the device 10. Such light hooks are deemed conventional.

Figure 5:
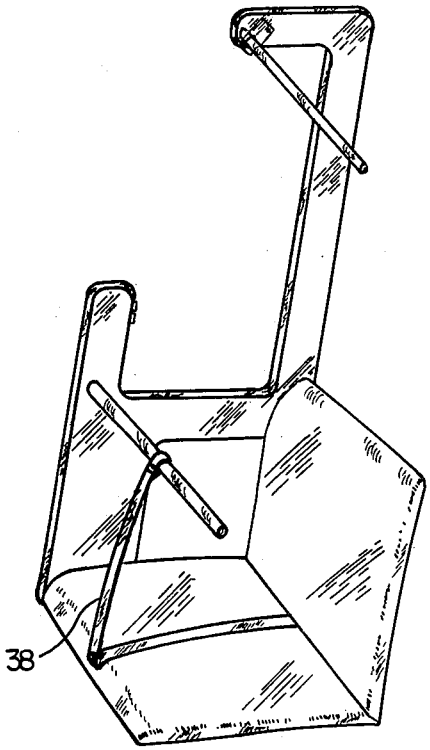
FIG. 5 is a cutaway perspective view of the device of this invention with a variant safety strap, wherein the device is to be employed as a swing.
Figure 6:
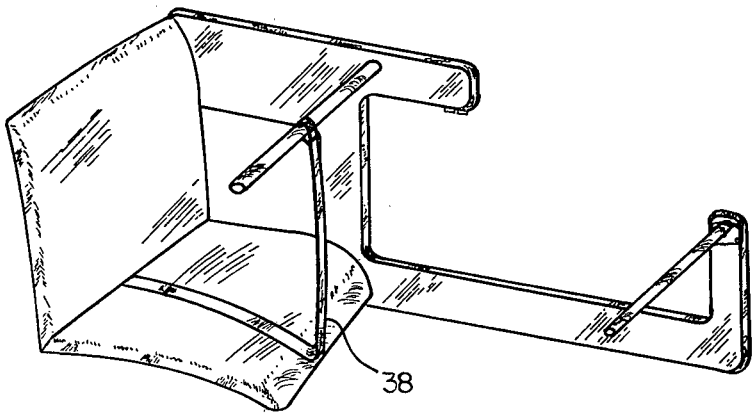
FIG. 6 is a cutaway perspective view of the device as seen in FIG. 5 but oriented for use as a seat.

In FIGS. 5 and 6 a variant method of attaching a crotch strap 38 is shown which differs from the one discussed relative to FIG. 1. Here the strap 38 is inserted on one end between the interface of seat portion 27 and back portion 28 and secured therein, as by stitching, stapling or other conventional means. The second end of said crotch strap 38 is secured to rod 22. Strap 38 is permitted to lie relatively loose rather than being drawn taught when being secured in place, such that when the device is oriented from seat to swing and back again, strap 38 will in the unsecured area, assume automatically by gravity, a reverse disposition such as to be useable as a crotch strap without any physical manipulation by the parent or child.

I claim:

1. A device mountable on a conventional table as a seat for an infant, which device upon orientation generally 90° is employable as an infant swing for attachment to a swing support, said device comprising:

a pair of spaced planar supporting side sections, said sections being interconnected by a plurality of bracing members to form an integral unit;

a seat body disposed between said planar supporting side sections, said seat body comprising a back portion supported generally vertically at one end of said unit and a seat portion extending generally normal to and from the bottom of said back portion inwardly of said unit and generally horizontally;

said spaced planar supporting side sections each including a first elongated horizontal member extending forwardly from a point along the side of said seat portion, and generally coaxial therewith, said horizontal member terminating in a pair of terminal generally vertical extending support members, said terminal support members also being generally parallel to said back portion, namely a forward and a rearward one, the rearward one of which is connected on its distal end to a second generally horizontal member extending forwardly from the top of the side of said back portion, above, spaced from, and parallel to said first horizontal member, said horizontal second member being connected along the length thereof to said rearward terminal vertical extending support, said horizontal second member terminating at a point beyond said rearward support member and distant from the forward terminal vertical support member, and wherein said bracing members which interconnect said planar side sections include a first bracing member interconnecting the forward terminal vertical members adjacent said upper ends thereof;

a second bracing member interconnecting said first horizontal members adjacent said seat portion;

a third bracing member interconnecting said second horizontal members at their fronts; and a fourth bracing member interconnecting said second horizontal members adjacent the top of said back portion, suspension means on or adjacent to the upper ends of each forward vertical terminal member for attaching a rope or chain thereto so said device can swing, whereby said device can be mounted to a table or the like by inserting said forward support members under said table in abutting engagement with the underside thereof, and the second horizontal members abutting against the upper surface of said table thereby providing a seat for an infant, said device also being adapted to be removable from said table and converted into a swing by attaching elongated flexible members to said suspension means, and positioning the infant's buttocks on the back portion, and the infant's back against the seat portion of said device.

2. In the device of claim 1 wherein said seat and back portions are comprised of a rigid material covered with a cushioned material.

3. In the device of claim 1 wherein said suspension means includes a pair of rings pivotally mounted along the length of said first bracing member and movable from a position about said upper end to a position below said upper end.

4. In the device of claim 1 including cushioning pads mounted on the underside of the front end of each of said second horizontal members.

5. In the device of claim 1 further including a crotch strap extending from about the midpoint of the junction of said seat and body portions up to about the midpoint of said third brace.

6. In the device of claim 1 including an adjustable seat belt secured to the back of said back portion.

7. In the device of claim 1 wherein said seat belt is detachably removable from said back portion.

8. In the device of claim 1 wherein said suspension means comprises a pair of elongated apertures, sized to receive a rope or cable, one in each of said forward terminal members.

* * * * *